US008888552B2

(12) United States Patent
Wizenberg et al.

(10) Patent No.: US 8,888,552 B2
(45) Date of Patent: Nov. 18, 2014

(54) TWISTABLE AND CONNECTABLE BLOCK

(75) Inventors: Darryl J. Wizenberg, Hong Kong (CN); Yiu Fai Yeung, Hong Kong (CN); Sin Yan Chua, Hong Kong (CN); Ying Fai Lai, Hong Kong (CN); Pui Kwan Woo, Hong Kong (CN); Chun Kit Tong, Hong Kong (CN)

(73) Assignee: JAKKS Pacific, Inc., Malibu, CA (US)

( * ) Notice: Subject to any disclaimer, the term of this patent is extended or adjusted under 35 U.S.C. 154(b) by 147 days.

(21) Appl. No.: 13/614,618

(22) Filed: Sep. 13, 2012

(65) Prior Publication Data

US 2013/0072082 A1 Mar. 21, 2013

Related U.S. Application Data

(60) Provisional application No. 61/535,148, filed on Sep. 15, 2011.

(51) Int. Cl.
*A63H 33/12* (2006.01)
*A63H 33/08* (2006.01)

(52) U.S. Cl.
CPC ..... *A63H 33/086* (2013.01)
USPC ..... 446/102

(58) Field of Classification Search
CPC ... A63H 33/06; A63H 33/062; A63H 33/067; A63H 33/08; A63H 33/086; A63H 33/088
USPC ..... 446/102, 104, 120, 124, 125
See application file for complete search history.

(56) References Cited

U.S. PATENT DOCUMENTS

| | | | | |
|---|---|---|---|---|
| 3,236,004 | A * | 2/1966 | Christiansen | 446/102 |
| 4,176,493 | A * | 12/1979 | Dideriksen | 446/102 |
| 4,185,410 | A * | 1/1980 | Kristiansen | 446/104 |
| 4,214,403 | A * | 7/1980 | Knudsen | 446/104 |
| 4,740,189 | A * | 4/1988 | Bertrand | 446/128 |
| 4,744,780 | A | 5/1988 | Volpe | |
| 5,000,713 | A | 3/1991 | Cheng | |
| 5,098,328 | A | 3/1992 | Beerens | |
| 5,154,656 | A | 10/1992 | Milstein | |
| 5,209,693 | A * | 5/1993 | Lyman | 446/104 |
| 5,411,428 | A * | 5/1995 | Orii et al. | 446/90 |
| 5,458,495 | A | 10/1995 | Stone | |
| 5,839,938 | A | 11/1998 | Manthei et al. | |
| 5,853,314 | A * | 12/1998 | Bora | 446/120 |
| 6,050,044 | A | 4/2000 | McIntosh | |
| 6,447,360 | B1 | 9/2002 | Sorensen | |
| 6,595,825 | B1 * | 7/2003 | De Wilde | 446/102 |
| 6,648,715 | B2 | 11/2003 | Wiens et al. | |
| 6,679,780 | B1 | 1/2004 | Shih | |
| 7,063,587 | B1 * | 6/2006 | Lin | 446/124 |
| 7,347,028 | B1 | 3/2008 | Bin-Nun et al. | |
| 7,648,407 | B1 | 1/2010 | Sorensen | |
| 7,749,042 | B2 | 7/2010 | Fulgenzi | |
| 7,882,674 | B2 | 2/2011 | Craven et al. | |

(Continued)

*Primary Examiner* — Kurt Fernstrom
(74) *Attorney, Agent, or Firm* — Tope-McKay & Associates

(57) ABSTRACT

Described is a twistable and connectable block. The block includes a first half and a second half. Each of the first half and second half having protrusions and recessions. The protrusions and recessions are formed to connect with other protrusions and recessions. Each of the halves is connectable with the other using a connection device. The connection device includes a post on one half that can fit in a corresponding hole in the other half. Thus, through the connection device, the two halves are twistable with respect to one another.

3 Claims, 19 Drawing Sheets

100

(56) References Cited

U.S. PATENT DOCUMENTS

| | | | | |
|---|---|---|---|---|
| 2008/0160875 | A1 | 7/2008 | Leicht | |
| 2009/0117815 | A1 | 5/2009 | Hiraide | |
| 2009/0298382 | A1 | 12/2009 | Ochi et al. | |
| 2010/0210173 | A1 | 8/2010 | Maggiore et al. | |
| 2011/0028064 | A1 | 2/2011 | Christensen et al. | |
| 2011/0076909 | A1 | 3/2011 | Hageman et al. | |
| 2012/0084767 | A1* | 4/2012 | Ishimoto | 717/173 |

* cited by examiner

100

1400

TWISTABLE AND CONNECTABLE BLOCK

CROSS-REFERENCE TO RELATED APPLICATIONS

This is a non-provisional application of U.S. Provisional Application No. 61/535,148, filed cm Sep. 15, 2011, and entitled, "Twistable and Connectable Block."

BACKGROUND OF THE INVENTION (1) Field of Invention

The present invention relates to a connectable block and, more particularly, to a connectable block, that includes two halves, each of the two halves being twistable with respect to one another.

(2) Description of Related Art

Toy blocks have long been known in the art. Toy blocks have evolved to include connectable protrusions and recessions that allow the blocks to be connectable and stackable. The present invention improves upon such traditional blocks by adding features that allow for new play operations other than simply stack and connecting.

SUMMARY OF INVENTION

The present invention relates to a connectable block that includes at least two parts (e.g., halves), each of the two parts being twistable with respect to one another. In one aspect, the connectable block includes a first part and a second part, each of the first part and second part having protrusions and recessions. In this aspect, the protrusions and recessions are formed, to connect with other protrusions and recessions on other connectable blocks. Further, each of the parts is connectable with the other using a connection device, whereby through the connection device, the two parts are twistable with respect to one another. For example, the connection device includes a post on one part that can fit in a corresponding hole in the other part.

Finally, as can be appreciated by one in the art, the present invention also comprises a method for forming and using the blocks described herein.

BRIEF DESCRIPTION OF THE DRAWINGS

The objects, features and advantages of the present invention will be apparent front the following detailed descriptions of the various aspects of the invention in conjunction with reference to the following drawings, where.

DETAILED DESCRIPTION

The present invention relates to a connectable block and, more particularly, to a connectable block that includes two halves, each of the two halves being twistable with respect to one another. The following description is presented to enable one of ordinary skill in the art to make and use the invention and to incorporate it in the context of particular applications. Various modifications, as well as a variety of uses in different, applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
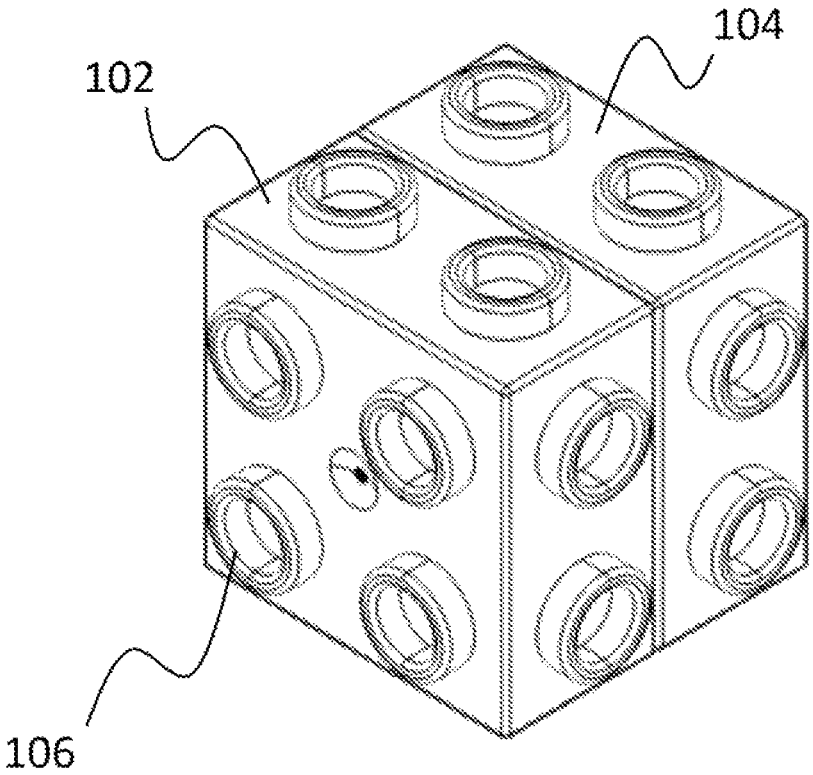
FIG. 1 is a front, perspective view illustration of a twistable and connectable block according to the present invention.
Figure 2:
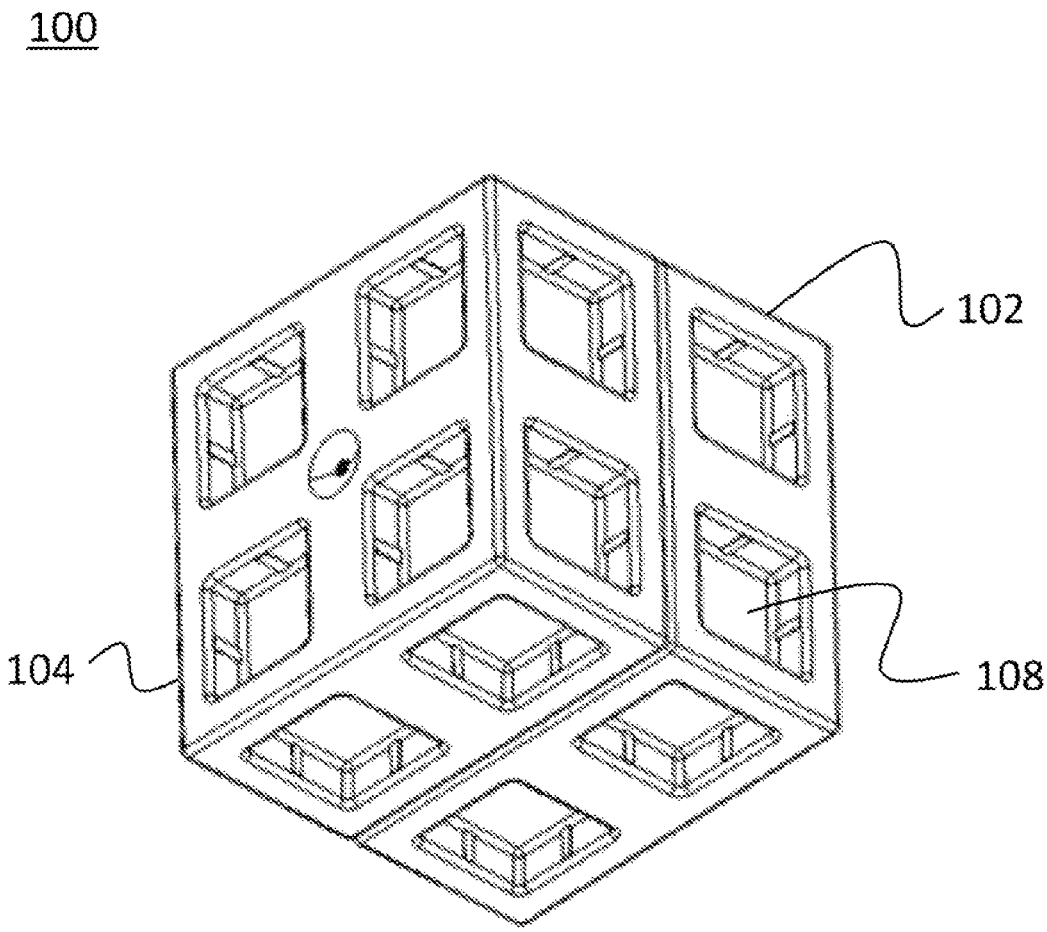
FIG. 2 is a back, perspective view illustration of the twistable and connectable block depicted in FIG. 1.

As shown in FIGS. 1 and 2, the present invention relates to a connectable block 100 that includes two halves, a first half 102 and a second half 104. Each of the two halves 102 and 104 are twistable with respect to one another. Also as shown between FIGS. 1 and 2, the halves 102 and 104 include protrusions 106 and corresponding recessions 108 to allow the block 100 to be connected with other blocks. Thus, the present invention is generally directed to connectable blocks 100 that have at least two parts (e.g., the two halves 102 and 104), with the parts being both connectable with other blocks and twistable with respect to one another. It should be understood that although the term half or halves is used herein, the invention is not intended to be limited thereto as it can be applied to blocks of any dimension and number of parts. For example, the two pans can be one-third and two-thirds, respectively, of the collective connectable block, or any other suitable dimension. Other non-limiting examples of which include having 3 parts, such as a first part that is one quarter the size of the collective connectable block, with the second part being one half and the third part being one quarter, respectively, of the collective block. Thus, as can be appreciated by one skilled in the art, the use of the term half or halves and as depicted in the figures is but one non-limiting aspect of the present invention.

For example, FIG. 1 illustrates a front, perspective view illustration of the block 100, while FIG. 2 illustrates a back, perspective view of the same block 100 as illustrated in FIG. 1. It is noted between FIGS. 1 and 2 that the protrusions 106 are circle-shaped, while the recessions 108 are square shaped. Importantly and also as illustrated, in one aspect, the same block 100 has both protrusions 106 and recessions 108. In the example as depicted in FIGS. 1 and 2, three adjacent sides of the six sides of the block 100 has protrusions 106 while the other three adjacent sides of the block 100 have recessions 108. This allows the block to both connect into (through its protrusions 106) and receive (through its recessions 108) other blocks.

The protrusions 106 and recessions 108 are formed in any suitable shape to allow the block 100 to be connected with other blocks, thereby creating stackable blocks. For example, both protrusions 106 and recessions 108 can be the same shape (e.g., both circle-shapes) or different shapes, (e.g., circle-shaped and square-shaped, respectively (as depicted)).

Figures 3A, 3B:
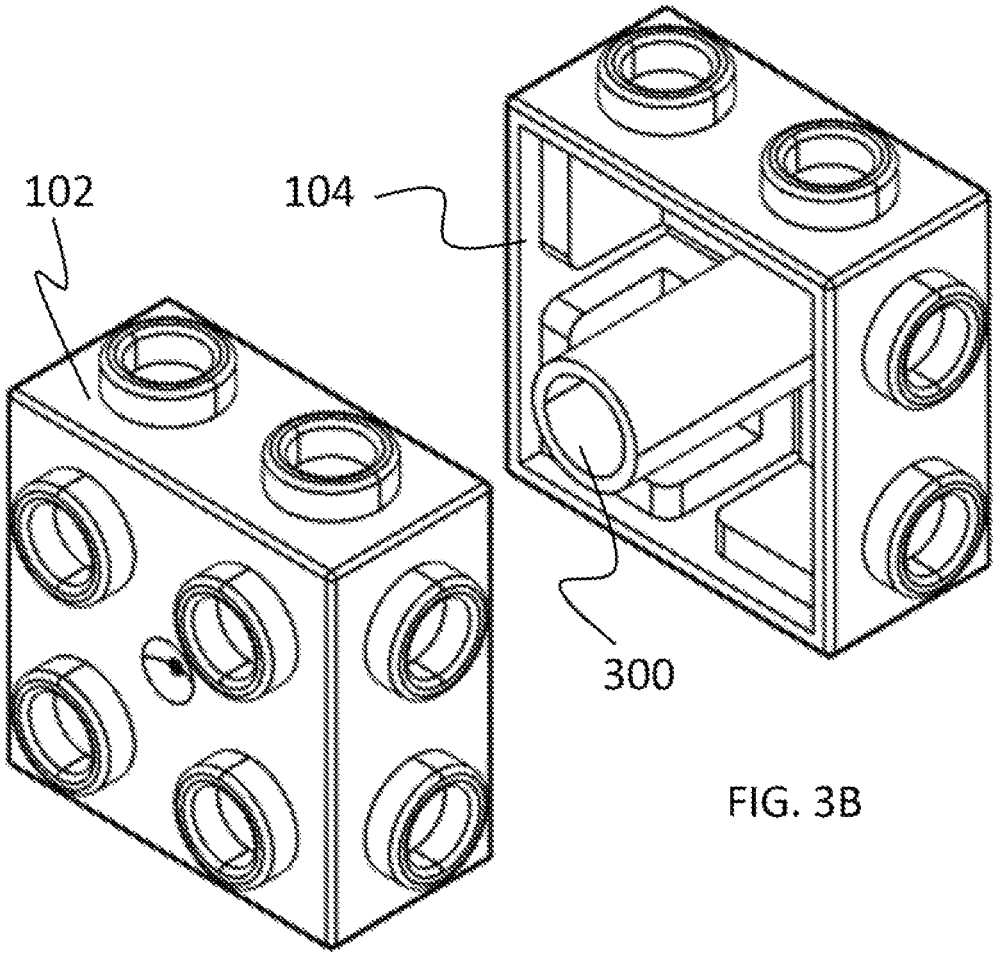
FIG. 3A is a front, perspective view illustration of a first half of the twistable and connectable block depicted in FIG. 1.
FIG. 3B is a front, perspective view illustration of a second half of the twistable and connectable block depicted in FIG. 1.

Importantly and as further illustrated in FIGS. 3A and 3B, the block 100 includes a first half 102 and a second half 104. Each of the halves 102 and 104 is connectable with the other using a connection device 300. The connection device 300 is any suitable mechanism, device, or connection technique that allows the two halves to be selectively connected with one another, a non-limiting example of which includes a post on one half that can fit in a corresponding hole in the other half. An advantage to the connection device in this aspect is that it allows each half to rotate (i.e., twist) with respect to the other. Thus, in this aspect, in addition to being connectable, the block 100 is also twistable.

Figure 4A:
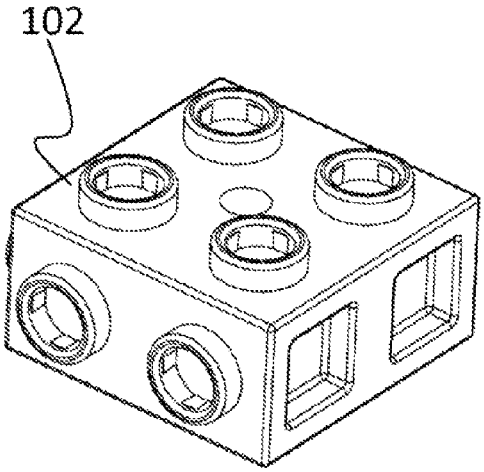
FIG. 4A is a top, perspective view illustration of the first half of the twistable and connectable block as depicted in FIG. 3A.
Figure 4B:
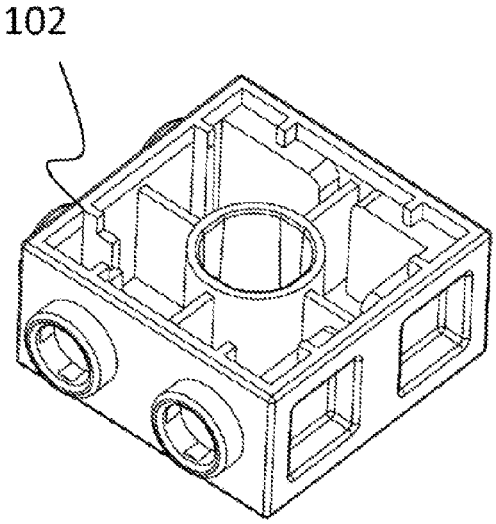
FIG. 4B is a bottom, perspective view illustration of the first half of the twistable and connectable block as depicted in FIG. 3A.

For further understanding, FIGS. 4A through 7F provide additional illustrations of the block 100 and its two halves. More specifically, FIG. 4A is a top, perspective view illustration of the first half 102 of the twistable and connectable block as depicted in FIG. 3A while FIG. 4B is a bottom, perspective view illustration of the first half 102 of the twistable and connectable block as depicted in FIG. 3A.

Figure 5A:
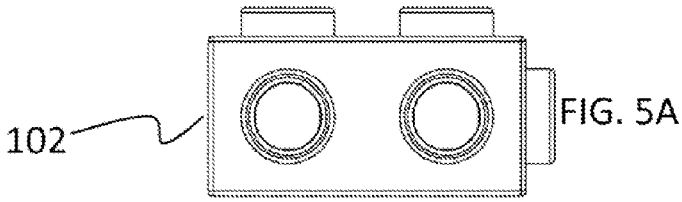
FIG. 5A is a front, view illustration of the first half of the twistable and connectable block as depicted in FIG. 3A.
Figure 5B:
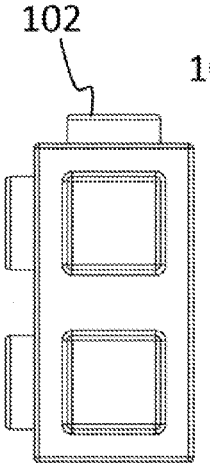
FIG. 5B is a left, view illustration of the first half of the twistable and connectable block as depicted in FIG. 3A.
Figure 5C:
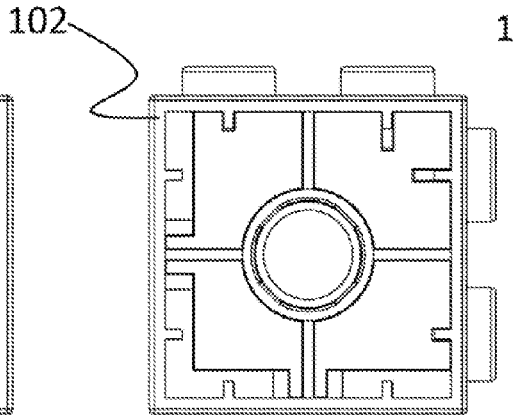
FIG. 5C is a bottom, view illustration of the first half of the twistable and connectable block as depicted in FIG. 3A.
Figure 5D:
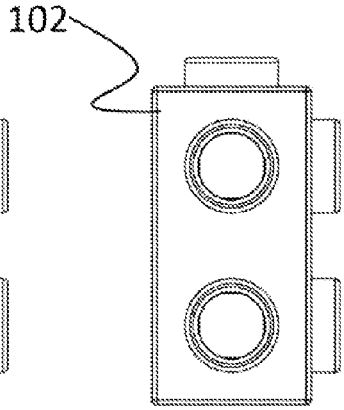
FIG. 5D is a right, view illustration of the first half of the twistable and collectable block as depicted in FIG. 3A.
Figure 5E:
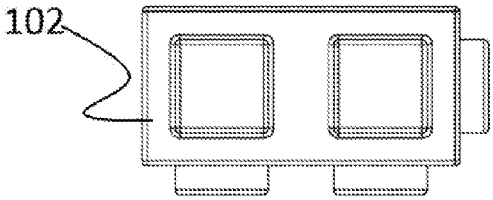
FIG. 5E is a rear, view illustration of the first half of the twistable and connectable block as depicted in FIG. 3A.
Figure 5F:
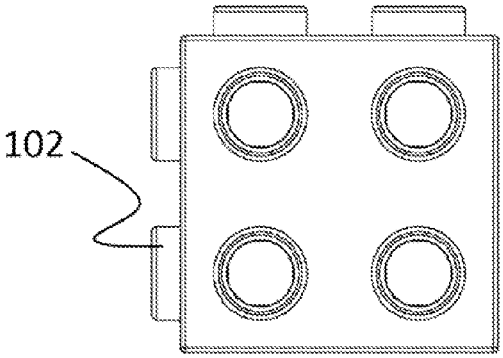
FIG. 5F is a top, view illustration of the first half of the twistable and connectable block as depicted in FIG. 3A.

Additional view points of the first half 102 are provided in FIGS. 5A through 5F. More specifically, FIG. 5A is a front, view illustration of the first half 102 of the twistable and connectable block as depicted in FIG. 3A; FIG. 5B is a left, view illustration of the first half 102 of the twistable and connectable block as depicted in FIG. 3A; FIG. 5C is a bottom, view illustration of the first half 102 of the twistable and connectable block as depicted in FIG. 3A; FIG. 5D is a right, view illustration of the first half 102 of the twistable and connectable block as depicted in FIG. 3A; FIG. 5E is a rear, view illustration of the first half 102 of the twistable and connectable block as depicted in FIG. 3A; FIG. 5F is a top, view illustration of the first half 102 of the twistable and connectable block as depicted in FIG. 3A.

Figure 6A:
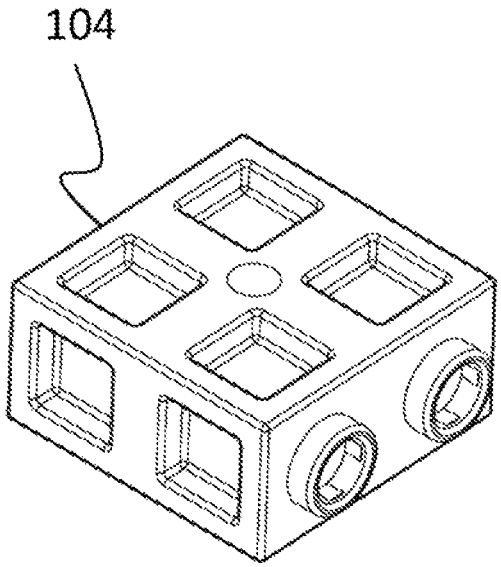
FIG. 6A is a top, perspective view illustration of the second half of the twistable and connectable block as depicted in FIG. 3B.
Figure 6B:
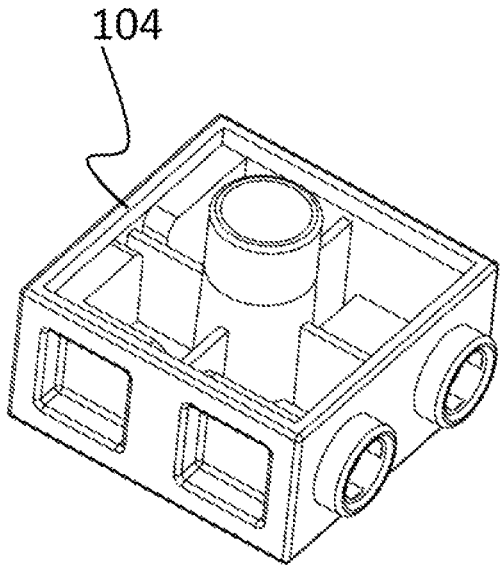
FIG. 6B is a bottom, perspective view illustration of the second half of the twistable and connectable block as depicted in FIG. 3B.

FIG. 6A is a top, perspective view illustration of the second half 104 of the twistable and connectable block as depicted in FIG. 3B, while FIG. 6B is a bottom, perspective view illustration of the second half 104 of the twistable and connectable block as depicted in FIG. 3B.

Figure 7A:
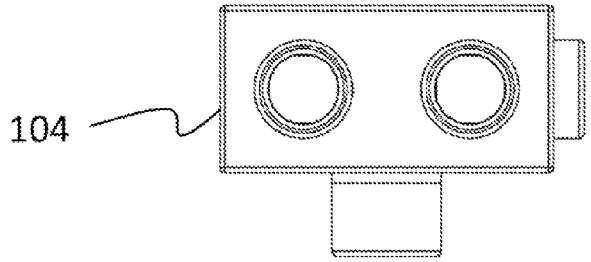
FIG. 7A is a front, view illustration of the second half of the twistable and connectable block as depicted in FIG. 3B.
Figure 7B:
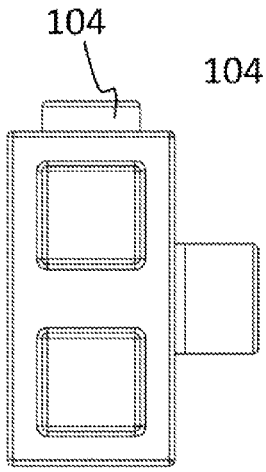
FIG. 7B is a left, view illustration of the second half of the twistable and connectable block as depicted in FIG. 3B.
Figure 7C:
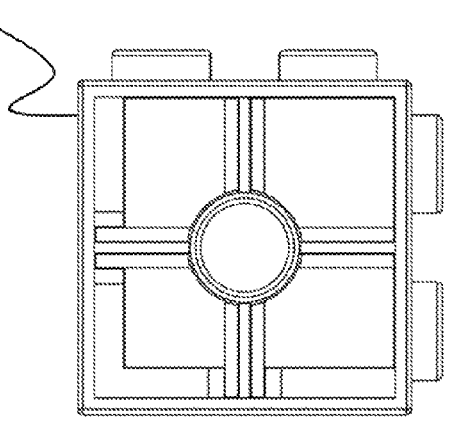
FIG. 7C is a bottom, view illustration of the second half of the twistable and connectable block as depicted in FIG. 3B.
Figure 7D:
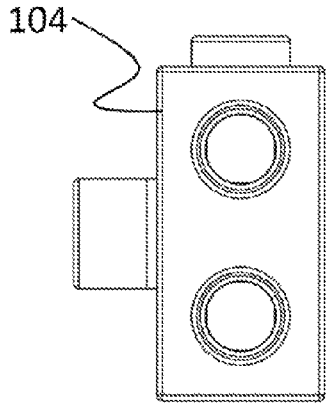
FIG. 7D is a right, view illustration of the second half of the twistable and connectable block as depicted in FIG. 3B.
Figure 7E:
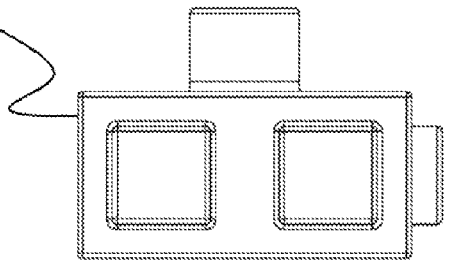
FIG. 7E is a rear, view illustration of the second half of the twistable and connectable block as depicted in FIG. 3B.
Figure 7F:
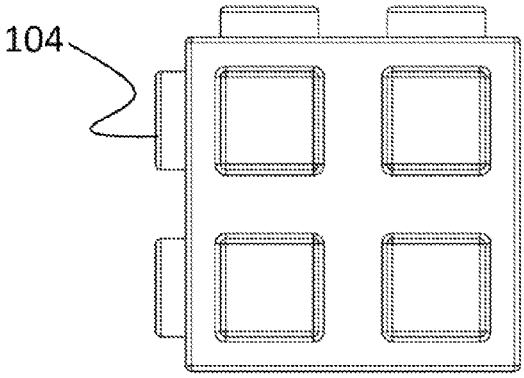
FIG. 7F is a top, view illustration of the second half of the twistable and connectable block as depicted in FIG. 3B.

Additional view points of the second half 104 are provided in FIGS. 7A through 7F. More specifically, FIG. 7A is a front, view illustration of the second half 104 of the twistable and connectable block as depicted in FIG. 3B; FIG. 7B is a left, view illustration of the second half 104 of the twistable and connectable block as depicted in FIG. 3B; FIG. 7C is a bottom, view illustration of the second half 104 of the twistable and connectable block as depicted in FIG. 3B; FIG. 7D is a right, view illustration of the second half 104 of the twistable and connectable block as depicted in FIG. 3B; FIG. 7E is a rear, view illustration of the second half 104 of the twistable and connectable block as depicted in FIG. 3B; and FIG. 7F is a top, view illustration of the second half 104 of the twistable and connectable block as depicted in FIG. 3B.

Figure 8A:
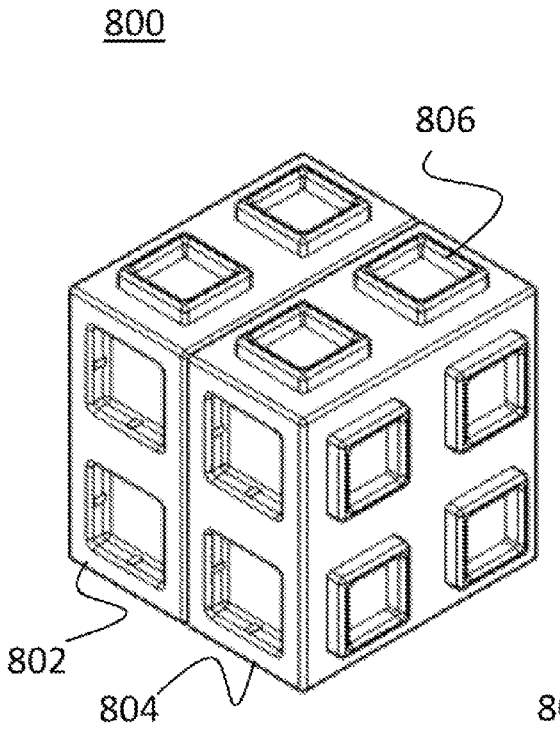
FIG. 8A is a front, perspective view illustration of another aspect of the twistable and connectable block according to the present invention.
Figure 8B:
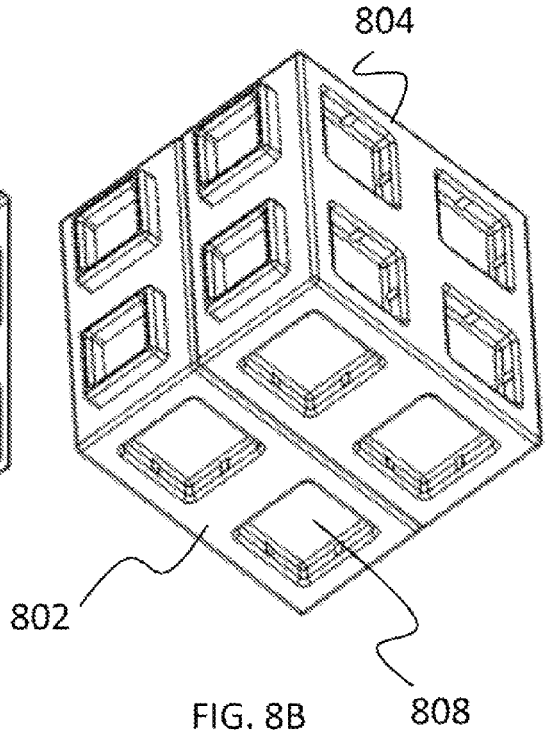
FIG. 8B is a back, perspective view illustration of the twistable and connectable block depicted in FIG. 8A.

FIGS. 1 and 2 are to be contrasted with FIGS. 8A and 8B, which illustrate another aspect of the block 800 according to the present invention. As shown in FIGS. 8A and 8B, each half (i.e., first half 802 and second half 804) includes protrusions 806 and recessions 808, with the protrusions 806 and recessions 808 being square-shaped. Thus, in this aspect, the protrusions 806 and recessions 808 are similarly shaped.

Figure 9A:
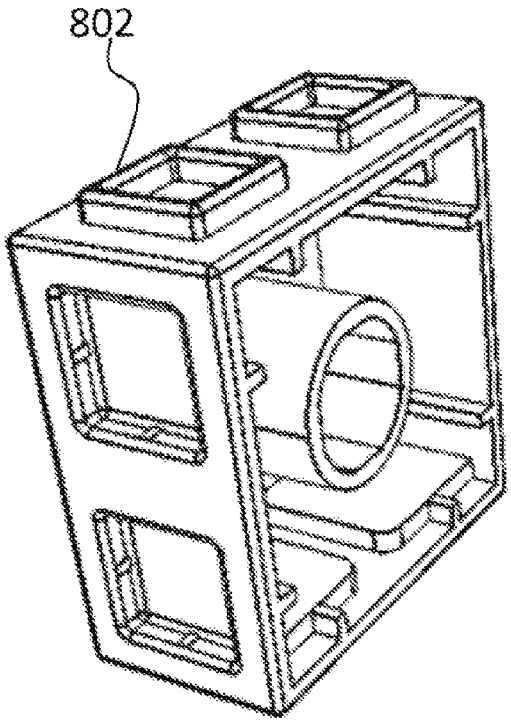
FIG. 9A is a perspective view illustration of a first half of the twistable and connectable block depicted in FIG. 8A.

For further understanding, FIGS. 9A through 13F provide additional illustrations of the block and its two halves 802 and 804. More specifically, FIG. 9A is a perspective view illustration of a first half 802 of the twistable and connectable block depicted in FIG. 8A, while FIG. 9B is a perspective view illustration of a second half 804 of the twistable and connectable block depicted in FIG. 8A. Additionally, FIG. 10A is a top, perspective view illustration of the first half 802 of the twistable and connectable block as depicted in FIG. 9A, while FIG. 10B is a bottom, perspective view illustration of the first half 802 of the twistable and connectable block as depicted in FIG. 9A.

Figure 11A:
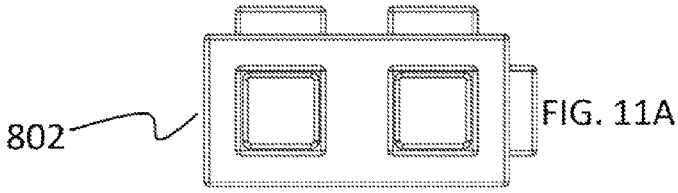
FIG. 11A is a front, view illustration of the first half of the twistable and connectable block as depicted in FIG. 9A.
Figure 11B:
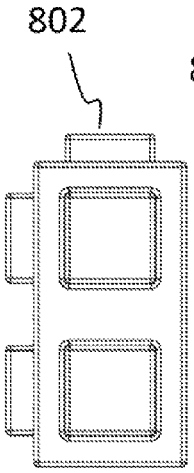
FIG. 11B is a left, view illustration of the first half of the twistable and connectable block as depicted in FIG. 9A.
Figure 11C:
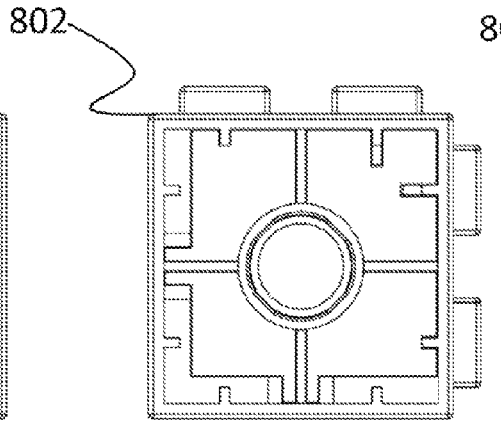
FIG. 11C is a bottom, view illustration of the first half of the twistable and connectable block as depicted in FIG. 9A.
Figure 11D:
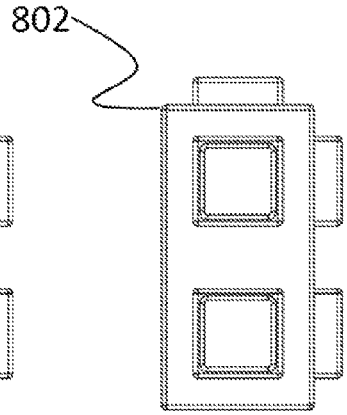
FIG. 11D is a right, view illustration of the first half of the twistable and connectable block as depicted in FIG. 9A.
Figure 11E:
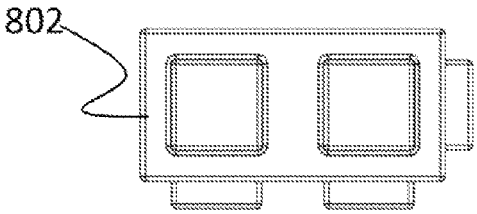
FIG. 11E is a rear, view illustration of the first half of the twistable and connectable block as depicted in FIG. 9A.
Figure 11F:
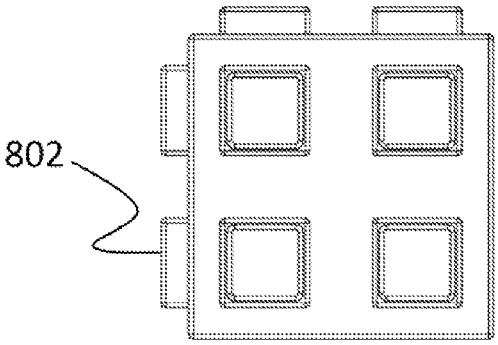
FIG. 11F is a top, view illustration of the first half of the twistable and connectable block as depicted in FIG. 9A.

Additional viewpoints are provided in FIGS. 11A through 11F. More specifically, FIG. 11A is a front, view illustration of the first half 802 of the twistable and connectable block as depicted in FIG. 9A; FIG. 11B is a left, view illustration of the first half 802 of the twistable and connectable block as depicted in FIG. 9A; FIG. 11C is a bottom, view illustration of the first half 802 of the twistable and connectable block as depicted in FIG. 9A; FIG. 11D is a right, view illustration of the first half 802 of the twistable and connectable block as depicted in FIG. 9A; FIG. 11E is a rear, view illustration of the first half 802 of the twistable and connectable block as depicted in FIG. 9A; and FIG. 11F is a top, view illustration of the first half 802 of the twistable and connectable block as depicted in FIG. 9A.

Figure 9B:
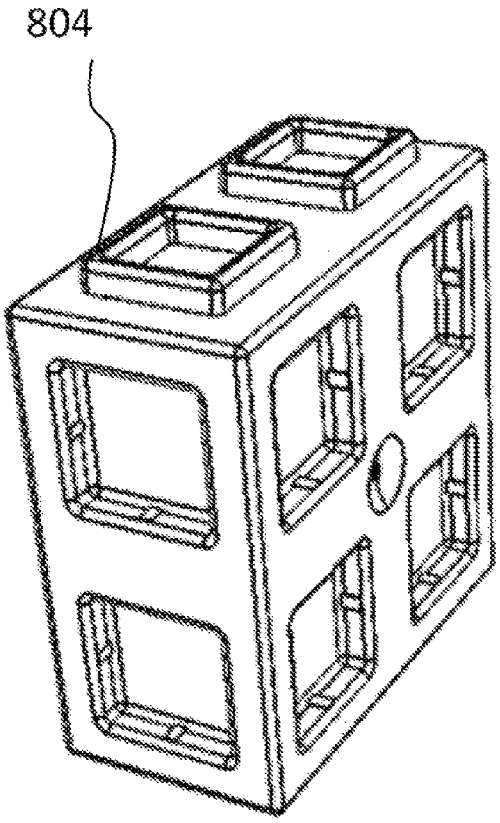
FIG. 9B is a perspective view illustration of a second, half of the twistable and connectable block depicted in FIG. 8A.
Figure 10A:
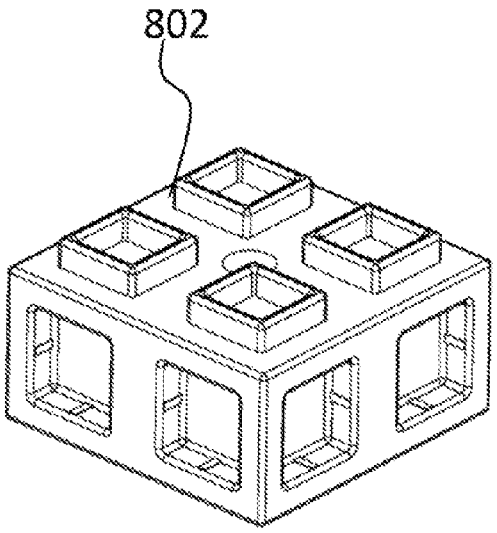
FIG. 10A is a top, perspective view illustration of the first half of the twistable and connectable block as depicted in FIG. 9A.
Figure 10B:
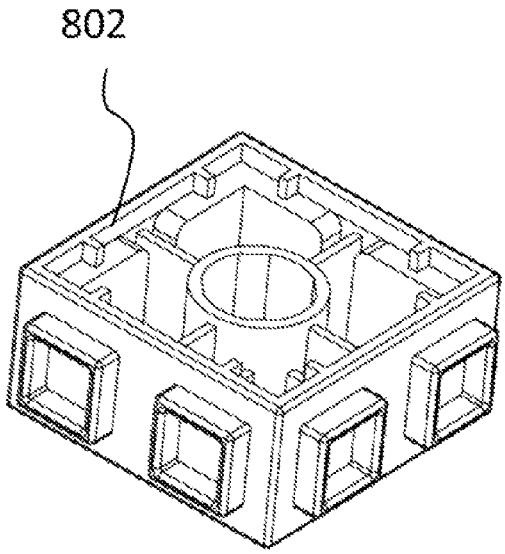
FIG. 10B is a bottom, perspective view illustration of the first half of the twistable and connectable block as depicted in FIG. 9A.
Figure 12A:
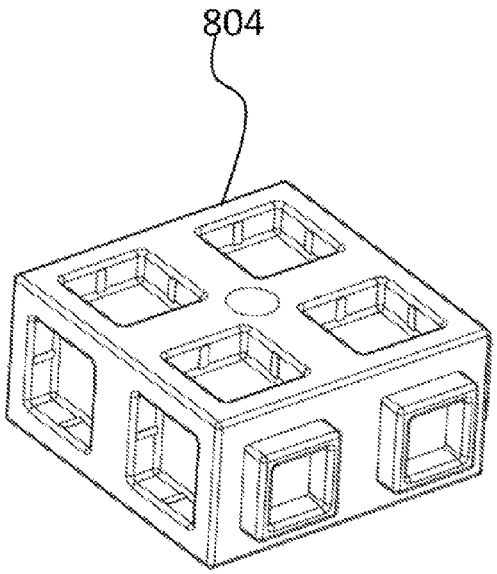
FIG. 12A is a top, perspective view illustration of the second half of the twistable and connectable block as depicted in FIG. 9B.
Figure 12B:
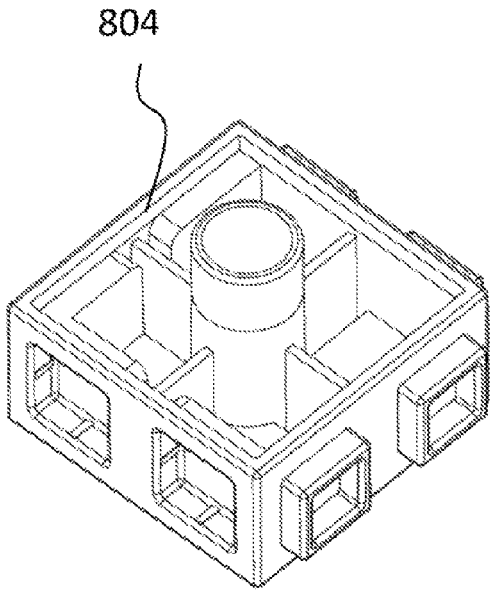
FIG. 12B is a bottom, perspective view illustration of the second half of the twistable and connectable block as depicted in FIG. 9B.
Figure 13A:
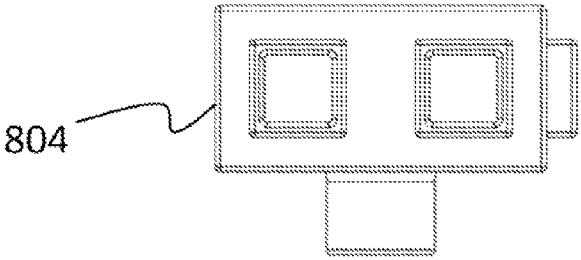
FIG. 13A is a front, view illustration of the second half of the twistable and connectable block as depicted in FIG. 9B.
Figure 13B:
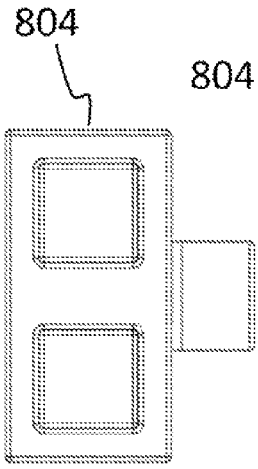
FIG. 13B is a left, view illustration of the second half of the twistable and connectable block as depicted in FIG. 9B.
Figure 13C:
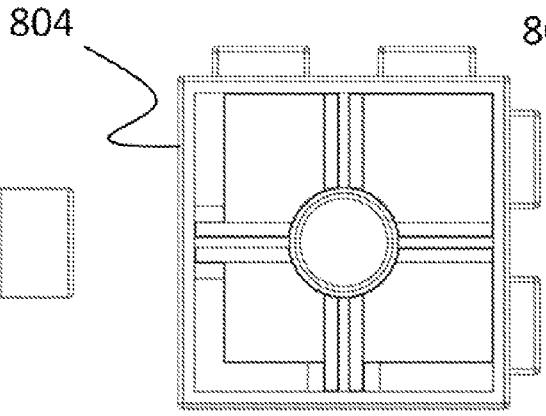
FIG. 13C is a bottom, view illustration of the second half of the twistable and connectable block as depicted in FIG. 9B.
Figure 13D:
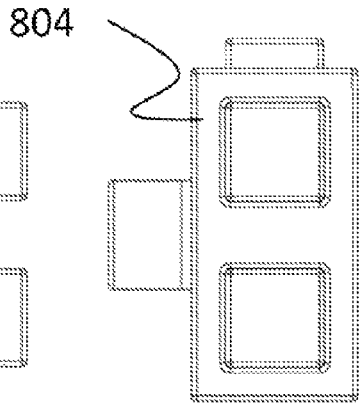
FIG. 13D is a right, view illustration of the second half of the twistable and connectable block as depicted in FIG. 9B.
Figure 13E:
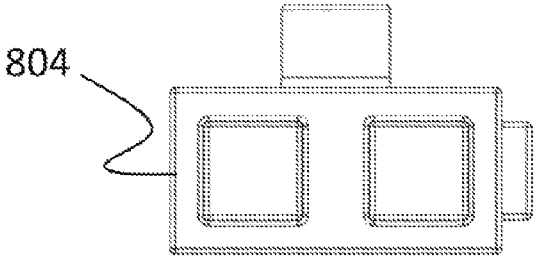
FIG. 13E is a rear, view illustration of the second half of the twistable and connectable block as depicted in FIG. 9B.
Figure 13F:
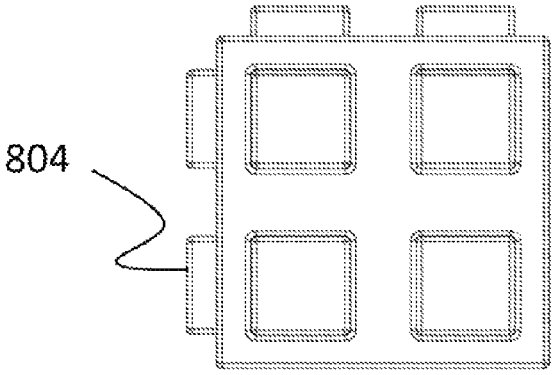
FIG. 13F is a top, view illustration of the second half of the twistable and connectable block as depicted in FIG. 9B.

Alternatively, FIG. 12A is a top, perspective view illustration of the second half 804 of the twistable and connectable block as depicted in FIG. 9B while FIG. 12B is a bottom, perspective view illustration of the second half 804 of the twistable and connectable block as depicted in FIG. 9B. Additional viewpoints of the second half 804 are depicted in FIGS. 13A through 13F. More specifically, FIG. 13A is a front, view illustration of the second half 804 of the twistable and connectable block as depicted in FIG. 9B; FIG. 13B is a left, view illustration of the second half 804 of the twistable and connectable block as depicted in FIG. 9B; FIG. 13C is a bottom, view illustration of the second half 804 of the twistable and connectable block as depicted in FIG. 9B; FIG. 13D is a right, view illustration of the second half 804 of the twistable and connectable block as depicted in FIG. 9B; FIG. 13E is a rear, view illustration of the second half 804 of the twistable and connectable block as depicted in FIG. 9B; and FIG. 13F is a top, view illustration of the second half 804 of the twistable and connectable block as depicted in FIG. 9B.

Figure 14A:
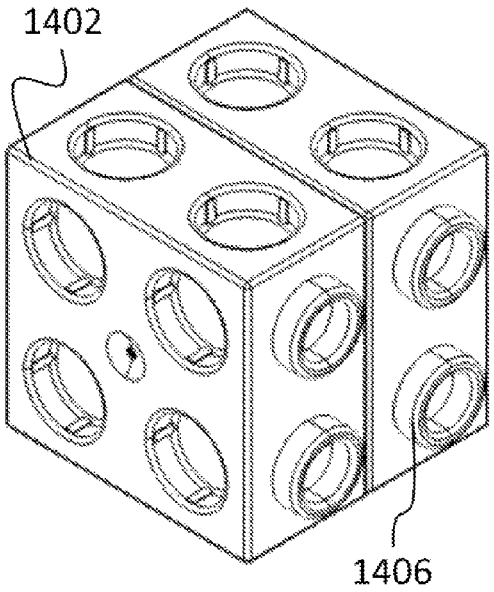
FIG. 14A is a front, perspective view illustration of another aspect of the twistable and connectable block according to the present invention.
Figure 14B:
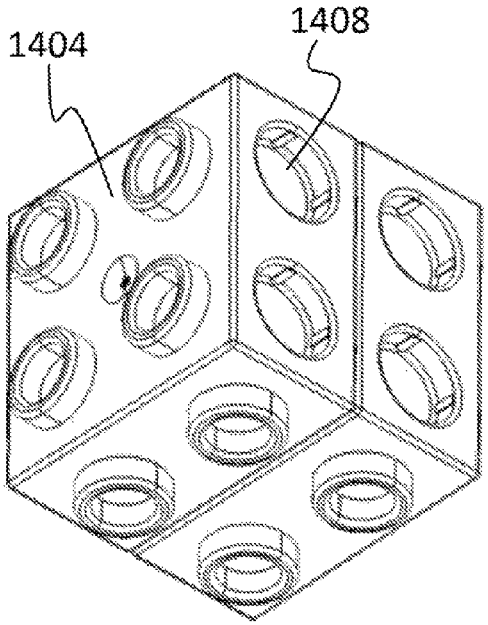
FIG. 14B is a back, perspective view illustration of the twistable and connectable block depicted in FIG. 14A.

FIGS. 8A and 8B are to be contrasted with FIGS. 14A and 14B, which illustrate another aspect of the block 1400 according to the present invention. As shown in FIGS. 14A and 14B, the each half 1402 and 1404 includes protrusions 1406 and recessions 1408, with the protrusions 1406 and recessions 1408 being round-shaped. Thus, in this aspect, the protrusions 1406 and recessions 1408 are also similarly shaped. Again, it should be understood that the protrusions 1406 and recesses 1408 can be similarly or dissimilarly shaped, provided that they are formed to connect with one another.

Figures 15A, 15B:
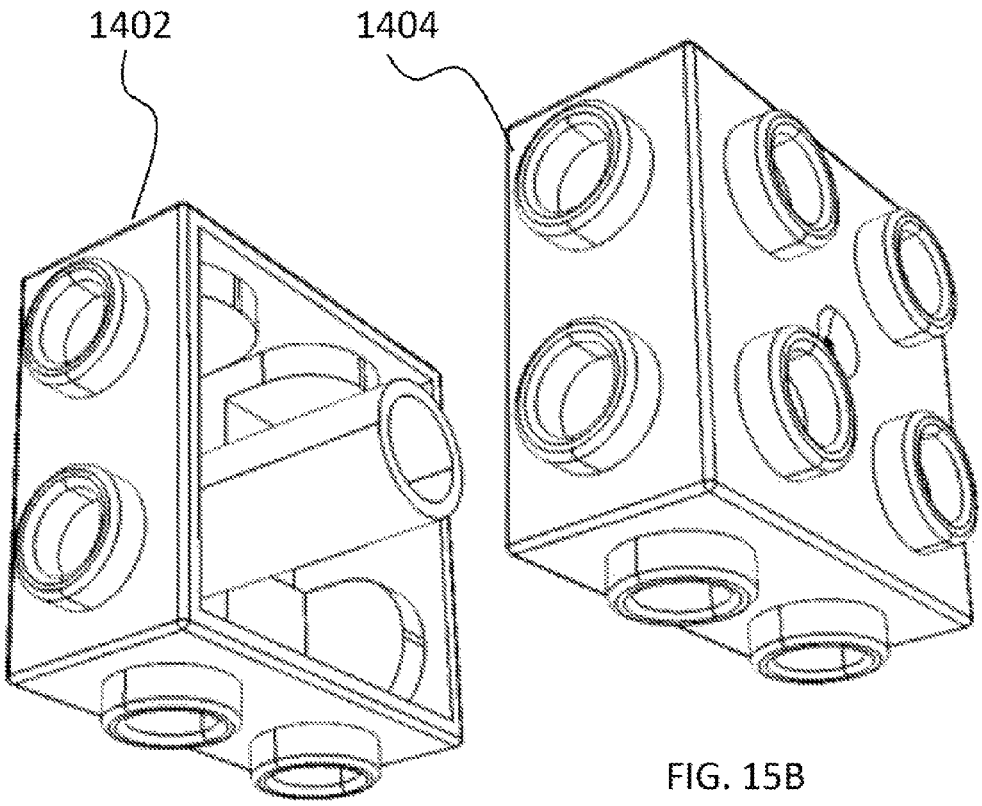
FIG. 15A is a perspective view illustration of a first, half of the twistable and connectable block depicted in FIG. 14A.
FIG. 15B is a perspective view illustration of a second half of the twistable and connectable block depicted in FIG. 14A.
Figure 16A:
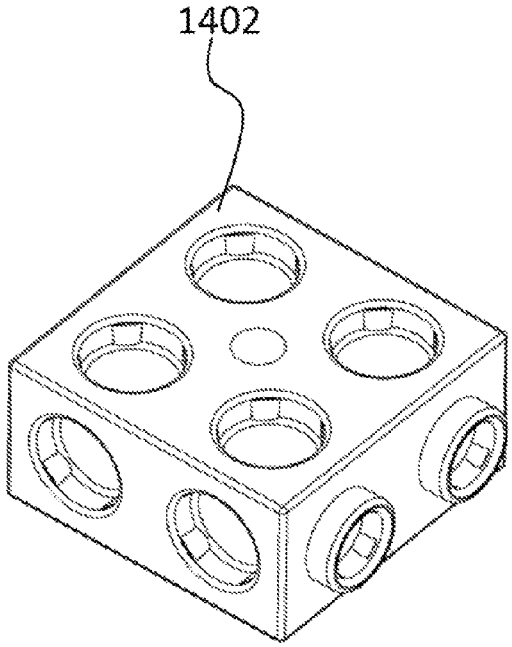
FIG. 16A is a top, perspective view illustration of the first half of the twistable and connectable block as depicted in FIG. 15A.
Figure 16B:
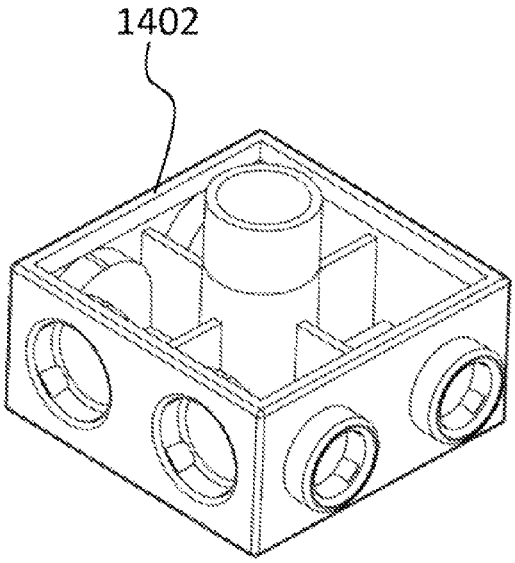
FIG. 16B is a bottom, perspective view illustration of the first half of the twistable and connectable block as depicted in FIG. 15A.

For further understanding, FIGS. 15A through 19F provide additional illustrations of the block and its two halves. More specifically, FIG. 15A is a perspective view illustration of a first half 1402 of the twistable and connectable block depicted in FIG. 14A while FIG. 15B is a perspective view illustration of a second half 1404 of the twistable and connectable block depicted in FIG. 14A. Further, FIG. 16A is a top, perspective view illustration of the first half 1402 of the twistable and connectable block while FIG. 16B is a bottom, perspective view illustration of the first half 1402 of the twistable and connectable block.

Figure 17A:
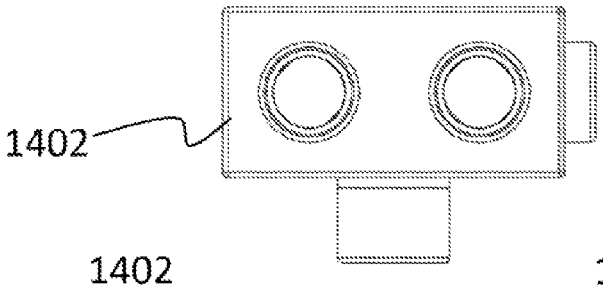
FIG. 17A is a front, view illustration of the first half of the twistable and connectable block as depicted in FIG. 15A.
Figure 17B:
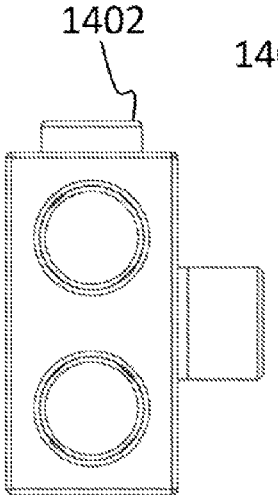
FIG. 17B is a left, view illustration of the first half of the twistable and connectable block as depicted in FIG. 15A.
Figure 17C:
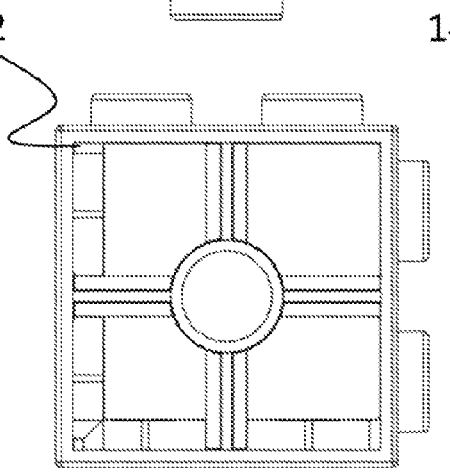
FIG. 17C is a bottom, view illustration of the first half of the twistable and connectable block as depicted in FIG. 15A.
Figure 17D:
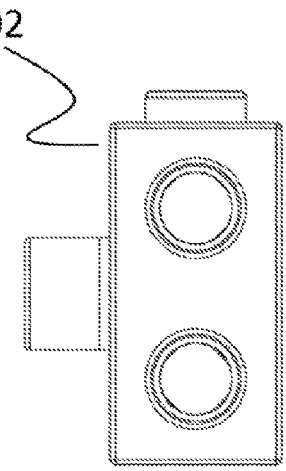
FIG. 17D is a right, view illustration of the first half of the twistable and connectable block as depicted in FIG. 15A.
Figure 17E:
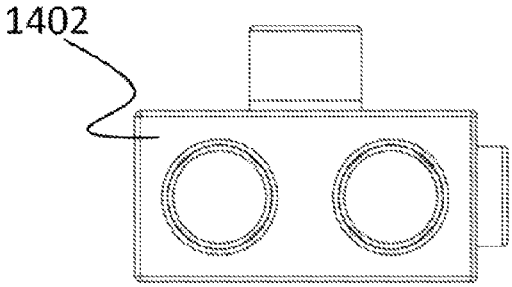
FIG. 17E is a rear, view illustration of the first half of the twistable and connectable block as depicted in FIG. 15A.
Figure 17F:
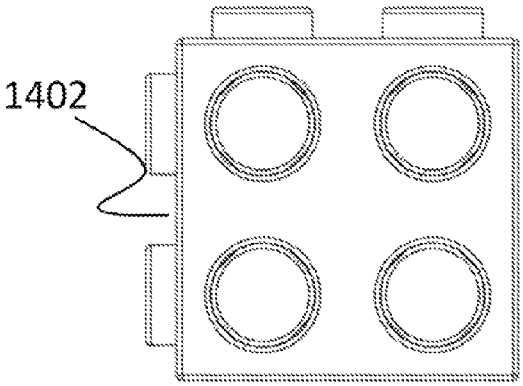
FIG. 17F is a top, view illustration of the first half of the twistable and connectable block as depicted in FIG. 15A.

Additional viewpoints are provided in FIGS. 17A through 17F. More specifically, FIG. 17A is a front, view illustration of the first half 1402 of the twistable and connectable block as depicted in FIG. 15A; FIG. 17B is a left, view illustration of the first half 1402 of the twistable and connectable block as depicted in FIG. 15A; FIG. 17C is a bottom, view illustration of the first half 1402 of the twistable and connectable block as depicted in FIG. 15A; FIG. 17D is a right, view illustration of the first half 1402 of the twistable and connectable block as depicted in FIG. 15A; FIG. 17E is a rear, view illustration of the first half 1402 of the twistable and connectable block as depicted in FIG. 15A; FIG. 17F is a top, view illustration of the first half 1402 of the twistable and connectable block as depicted in FIG. 15A.

Figure 18A:
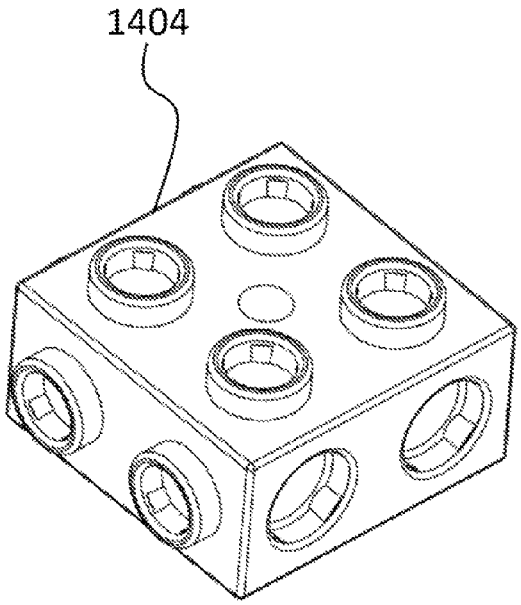
FIG. 18A is a top, perspective view illustration of the second half of the twistable and connectable block as depicted in FIG. 15B.
Figure 18B:
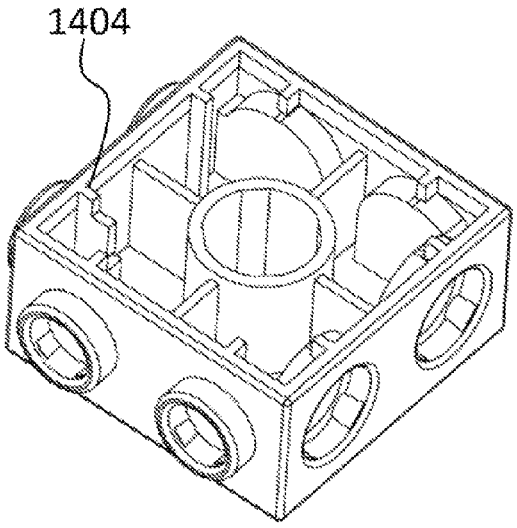
FIG. 18B is a bottom, perspective view illustration of the second half of the twistable and connectable block as depicted in FIG. 15B.
Figure 19A:
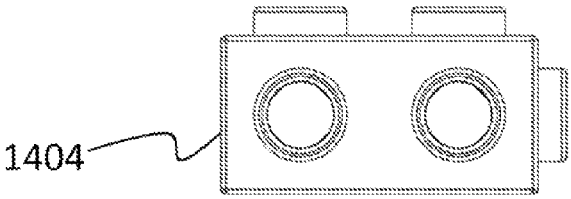
FIG. 19A is a front, view illustration of the second half of the twistable and connectable block as depicted in FIG. 15B.
Figure 19B:
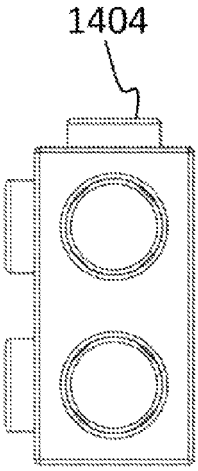
FIG. 19B is a left, view illustration of the second half of the twistable and connectable block as depicted in FIG. 15B.
Figure 19C:
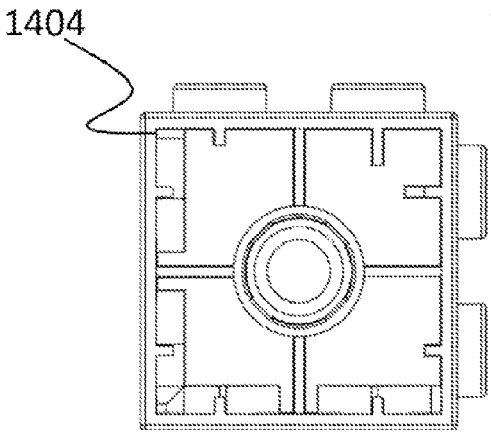
FIG. 19C is a bottom, view illustration of the second half of the twistable and connectable block as depicted in FIG. 15B.
Figure 19D:
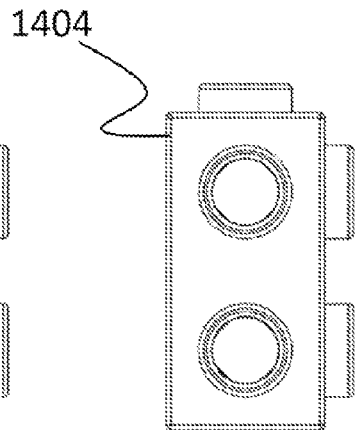
FIG. 19D is a right, view illustration of the second half of the twistable and connectable block as depicted in FIG. 15B.
Figure 19E:
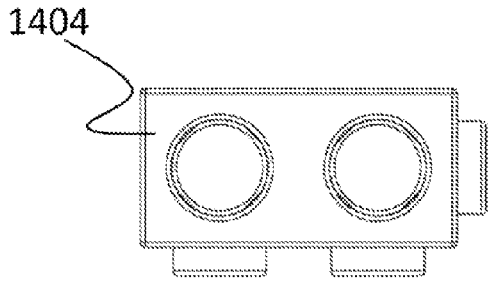
FIG. 19E is a rear, view illustration of the second half of the twistable and connectable block as depicted in FIG. 15B.
Figure 19F:
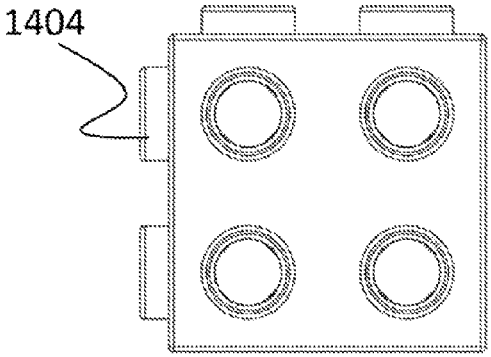
FIG. 19F is a top, view illustration of the second half of the twistable and connectable block as depicted in FIG. 15B.

Alternatively, FIG. 18A is a top, perspective view illustration of the second half 1404 of the twistable and connectable block as depicted in FIG. 15B while FIG. 18B is a bottom, perspective view illustration of the second half 1404 of the twistable and connectable block as depicted in FIG. 15B. Additional viewpoints of the second half 1404 are provided in FIGS. 19A through 19F. More specifically, FIG. 19A is a front, view illustration of the second half 1404 of the twistable and connectable block as depicted in FIG. 15B; FIG. 19B is a left, view illustration of the second half 1404 of the twistable and connectable block as depicted in FIG. 15B; FIG. 19C is a bottom, view illustration of the second half 1404 of the twistable and connectable block as depicted in FIG. 15B; FIG. 19D is a right, view illustration of the second half 1404 of the twistable and connectable block as depicted in FIG. 15B; FIG. 19E is a rear, view illustration of the second half 1404 of the twistable and connectable block as depicted in FIG. 15B; and FIG. 19F is a top, view illustration of the second half 1404 of the twistable and connectable block as depicted in FIG. 15B.

It should be understood that the connectable block and its components are formed of any suitable material, non-limiting examples of which include plastic, metal, glass, wood, etc. Further and as noted above, the connectable block and its components can be formed in any suitable shape that allows for them to be connected with other blacks as stackable and connectable blocks and, as such, are not limited to a cube shape or any other particular shape.

What is claimed is:

1. A twistable and connectable block, comprising:

a first part, the first part having at least six distinct sides, with three of the sides having protrusions, two of the sides having recessions, and one of the sides having a connection device:

a second part, the second part having at least six distinct sides, with three of the sides having recessions, two of the sides having protrusions, and one of the sides having a connection device, such that the protrusions and recessions are formed to connect with other protrusions and recessions on other blocks; and wherein the connection device of the first part is connected with the connection device of the second part such that the two parts are twistable with respect to one another.

2. The twistable and connectable block as set forth in claim 1, wherein the connection device includes a post on one part that can fit in a corresponding hole in the other part.

3. The twistable and connectable blocl as set forth in claim 2, wherein the first part is a first half of the connectable block and the second part is a second half of the connectable block.

* * * * *